United States Patent [19]

Fehrer

[11] 4,334,400

[45] Jun. 15, 1982

[54] APPARATUS FOR MAKING A YARN

[76] Inventor: Ernst Fehrer, Auf der Gugl 28, Linz, Austria

[21] Appl. No.: 227,366

[22] Filed: Jan. 22, 1981

[30] Foreign Application Priority Data

| | | | |
|---|---|---|---|
| Jan. 28, 1980 | [AT] | Austria | 427/80 |
| Feb. 19, 1980 | [AT] | Austria | 902/80 |
| Mar. 3, 1980 | [AT] | Austria | 1147/80 |

[51] Int. Cl.[3] ..... D01H 1/135; D02G 3/36

[52] U.S. Cl. ..... 57/5; 57/401

[58] Field of Search ..... 57/5, 6, 58.89–58.95

[56] References Cited

U.S. PATENT DOCUMENTS

| | | | |
|---|---|---|---|
| 3,439,491 | 4/1969 | Scruggs | 57/5 |
| 4,070,811 | 1/1978 | Fehrer | 57/58.95 X |
| 4,107,909 | 8/1978 | Fehrer et al. | 57/5 |
| 4,241,571 | 12/1980 | Turk et al. | 57/58.89 |

FOREIGN PATENT DOCUMENTS

| | | | |
|---|---|---|---|
| 345701 | 10/1978 | Austria | 57/5 |

*Primary Examiner*—John Petrakes
*Attorney, Agent, or Firm*—Kurt Kelman

[57] ABSTRACT

Apparatus for making a yarn comprises two juxtaposed, closely spaced apart suction drums which rotate in the same sense and a delivery duct which protrudes into the triangular space between the suction drums and has an exit adjacent to the suction zones and serves to deliver through said exit singled covering fibers to a drawn roving, which has been delivered by a drawing frame disposed to said triangular space at one end thereof. The yarn thus formed in the triangular space between the suction drums is withdrawn by withdrawing means disposed from said triangular space at the other end thereof. In order to improve the wrapping of the roving with the covering fibers, the surfaces of the suction drums are rough and have a microstructure which will prevent a positive coupling to individual covering fibers and has a peak-to-valley depth up to one-half of the yarn diameter.

8 Claims, 4 Drawing Figures

APPARATUS FOR MAKING A YARN

Figure 1:
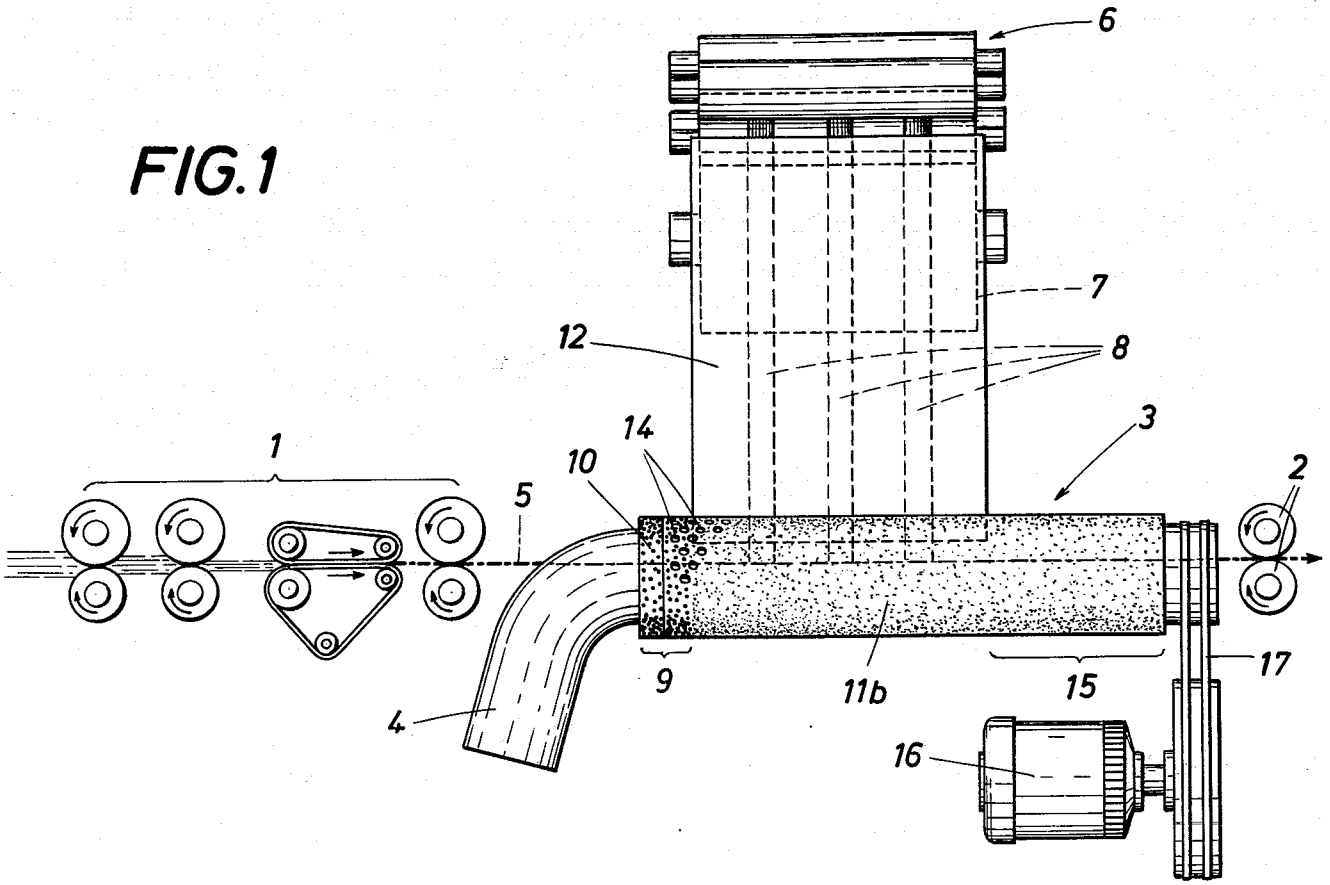

This invention relates to apparatus for making a yarn comprising two juxtaposed, closely spaced apart suction drums, which rotate in the same sense and have suction zones defining a generally triangular space, a drawing frame for delivering a drawn roving to said triangular space at one end thereof, a delivery duct having an exit in said triangular space adjacent to said suction zones and serving to deliver singled covering fibers through said exit to said roving in said triangular space so as to form a yarn, and means for withdrawing said yarn from said triangular space at the other end thereof.

In such apparatus, the roving is twisted between the two suction drums or by a twisting member preceding said triangular space and the covering fibers are wound on the twisting roving so as to fix the twist thereof. For that purpose the covering fibers should be tied in the roving as the fibers impinge on the roving and should be wound around the fibers of the roving immediately thereafter so that the singled covering fibers will not be pushed across the roving. Such pushing of the fibers would adversely affect the quality of the resulting yarn. The covering fibers delivered to said triangular space are suitably parallelized and extend transversely to the roving. For an immediate winding of the singled covering fibers around the roving, the surfaces of the suction drums must contact the covering fibers at their forward ends as they enter the zone of yarn formation and must wind said ends around the roving. This requires a correspondingly high entraining force to be exerted. In known apparatus the suction drums have polished, smooth surfaces so that the surfaces of the suction drums cannot pull individual covering fibers out of the zone of yarn formation. The entraining force will mainly depend on the suction force by which the fibers are drawn into the triangular space between the suction drums and urged against the surfaces of the drums. As the suction forces which can be exerted economically are limited, the wrapping of the roving with covering fibers in the known apparatus is subject to restrictions, which will be particularly significant if the covering fibers are rather stiff.

It is an object of the invention so to improve an apparatus of the kind described first hereinbefore that the forces tending to wind the covering fibers around the roving will be increased so that the covering fibers can be more properly wound around the roving.

This object is accomplished according to the invention in that the surfaces of the suction drums are rough and have a microstructure which will prevent a positive coupling of said surfaces to individual covering fibers and has a peak-to-valley height which is up to one-half of the diameter of the yarn.

Whereas the rough surfaces of the suction drums result in an increased friction between said surfaces and the fibers and in conjunction with given suction forces will result in stronger entraining forces, which are desirable for a good winding of the fibers, the measures stated will prevent a pulling of individual fibers from the line on which the yarn is formed. This is due to the fact that the duct for delivering the singled covering fibers has an exit close to the suction zones and because the rough surfaces of the suction drums have a microstructure which will prevent a positive coupling of said surfaces to individual covering fibers. As a result, the covering fibers can contact the surfaces of the drums only in the suction zones, where they are entrained by the sucked air and are retained by it against drifting. It is apparent that the covering fibers are subjected to a retaining force, which prevents the covering fibers from being entrained by the surfaces of the suction drums out of the zone of yarn formation. Owing to the increased entraining force, a higher winding torque is exerted on the covering fibers. As a result, the covering fibers will be tied into and wound around the roving as soon as they impinge on the surfaces of the drums or on the roving so that the undesired pushing action will be avoided even when the covering fibers are rather stiff. Because the roving is more properly covered, finer yarns of more uniform quality can be made. Higher withdrawing speeds can be used because the slip between the covering fibers and the surfaces of the suction drums is decreased.

To prevent a drifting of individual fibers from the zone of yarn formation, there must be no positive coupling between the surfaces of the suction drums and the covering fibers. For this reason, there is an upper limit to the peak-to-valley height of the microstructure of the surface. That upper limit will depend on the diameter, the weight, the surface properties and the length of the covering fibers. If the peak-to-valley height is substantial, although it is within the permissible range, the profile of the microstructure should be free from distinct edges or peaks. On the other hand, the peak-to-valley height must not be such as to disturb the steady guidance of the yarn in the triangular space. For this reason the peak-to-valley height must be less than an upper limit, which depends on the yarn diameter. If the peak-to-valley height is less than one-half of the yarn diameter, the guidance of the yarn and the stability of the line of yarn formation will not be disturbed by the rough surfaces of the drum.

Because the nature of the roughness of the surfaces of the suction drums is essential, the methods by which said rough surfaces are made is not critical provided that the described requirements as regards microstructure and peak-to-valley depth are met. The desired roughness of the surfaces may be achieved by a mechanical or chemical treatment, for instance, by embossing, by blasting with abrasive, or by etching. Alternatively, a covering of particles having a suitable size may be applied.

Particularly good results will be obtained if the peak-to-valley height is up to one-fourth of the yarn diameter and/or up to five times the diameter of the covering fibers. A selection of the peak-to-valley height with a view to the diameter of the covering fibers will ensure that the surfaces of the suction drums cannot entrain individual covering fibers out of the zone of yarn formation. The ratios stated apply to the coarsest yarn that can be made on a given apparatus.

Whereas suction drums having structured surfaces are known (German Early Disclosure 28 10 184), such surfaces are formed with helical ridges having a height in excess of the yarn diameter and the ridges of the two suction drums mesh and tend to axially convey the yarn which is to be made. It will be understood that such suction drums cannot produce the results which are achieved according to the invention.

Because the hardness of the yarn will depend also on the position of the roving and yarn in the triangular space as the covering fibers are wound the more tightly around the roving the deeper the latter is pulled into the triangular space, the hardness of the yarn can be controlled by the control of that position. This has previously been accomplished by a proper adjustment of the suction force which is exerted through the suction zones on the yarn and which pulls the yarn into the tapering triangular space between the suction drums. As the rough surfaces are employed in order to reduce the influence of the suction force, it is proposed to control the hardness of the yarn in that one suction drum is rotated into the triangular space at a peripheral velocity which is 3 to 20% lower than that of the other suction drum, which rotates out of the triangular space.

In the triangular space between the suction drums the yarn is subjected to the suction forces which pull the yarn into the tapering gap between the drums and to the entraining forces exerted by the surfaces of the drums due to friction. The entraining forces exerted by the drum which rotates toward the triangular space tend to move the yarn into the triangular space, in the same direction as the suction forces. The suction drum which rotates away from the triangular space tends to move the yarn out of the triangular space and thus opposes the suction forces. For this reason the resultant force drawing the yarn into the triangular space can be controlled by a control of the difference between the peripheral velocities of the two suction drums. Higher and lower peripheral velocities involve larger and smaller torques and larger and smaller entraining forces, respectively. The slower the movement of the drum which rotates toward the triangular space, the smaller will be the resultant force drawing the yarn into the triangular space and the less tightly will the covering fibers be wound around the roving. The higher the velocity of the suction drum which rotates toward the triangular space, the more tightly will the roving be wrapped. It has been found that yarns of all practical hardnesses can be obtained if the peripheral velocity of the suction drum which rotates toward the triangular space can be controlled to be 3 to 20% less than the peripheral velocity of the other drum. The usual difference between the peripheral velocity of the two suction drums will be between 5 and 10% because a yarn having a generally desired softness will be obtained with differences in that range.

If in a further development of the invention provision is made for an adjustment of the speed of the drum which rotates toward the triangular space, different yarns can be made with one and the same apparatus without alteration. In practice there is mainly a need for apparatus for making a specific yarn.

A desired position of the yarn in the triangular space between the suction drums can also be ensured in that the microstructure of the surface of the suction drum which rotates toward the triangular space differs from the microstructure of the surface of the other suction drum, which rotates away from the triangular space, in such a manner that the entraining force exerted by the entraining surface of the former drum is smaller by up to 30% than the entraining force exerted by the surface of the latter drum.

Because the yarn is subjected in the triangular space between the suction drums to the suction forces drawing the yarn into the tapering gap between the suction drums and to the entraining forces exerted by the surfaces of the drums due to friction, the resultant force pulling the yarn into the triangular space can be controlled by the ratio of the entraining forces acting on the yarn in opposite senses. Under given conditions in other respects, the entraining forces will depend only on the frictional coupling between the surfaces of the drums and the covering fibers so that the position of the yarn in the triangular space can also be controlled by the selection of the microstructure of the surface of that drum which rotates toward the triangular space. If the entraining forces exerted by the surface of the suction drum which rotates toward the triangular space are reduced and a suction force is selected which is favorable as regards the urging of the covering fibers against the surface of the drum, a relatively small resultant force pulling the yarn into the triangular space will be sufficient. Whereas the friction forces can obviously be influenced as desired by the selection of the profile of the microstructure, particularly simple conditions will be obtained if the peak-to-valley height of the surface of the suction drum rotating toward the triangular space is correspondingly less than the peak-to-valley height of the surface of the other drum, which rotates out of the triangular space.

To permit an advantageous utilization of the twisting action for the winding of the covering fibers, the surface of the suction drum rotating toward the triangular space must still exert an adequate entraining force on the covering fibers. For this reason the microstructure of that surface must be selected so that such adequate entraining force will be exerted. It has been found that all requirements can be met if said entraining forces are up to 30% less than the entraining forces exerted by the surface which rotates away from the triangular space.

Figure 2:
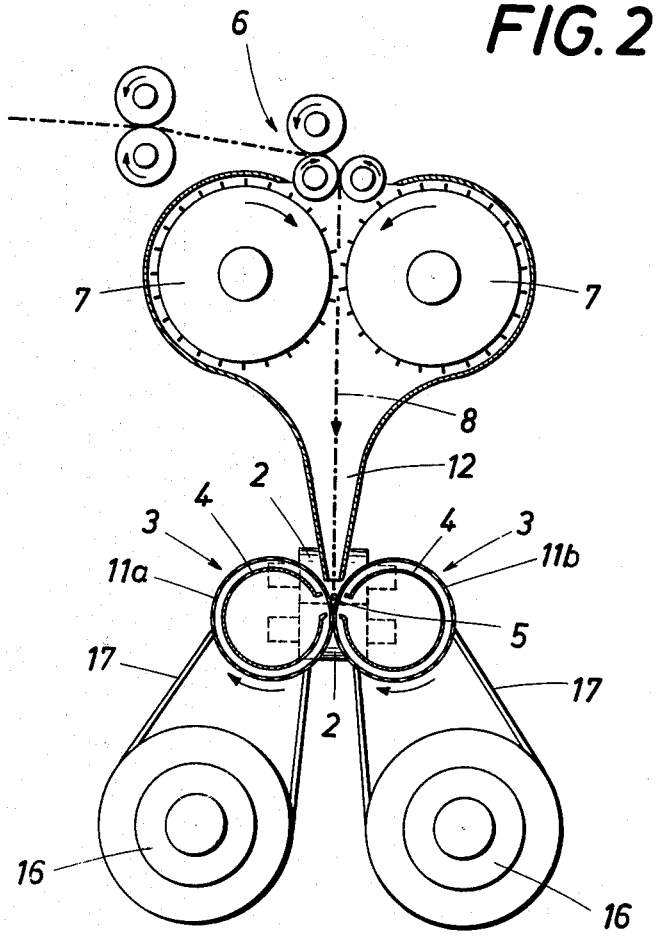
Figure 3:
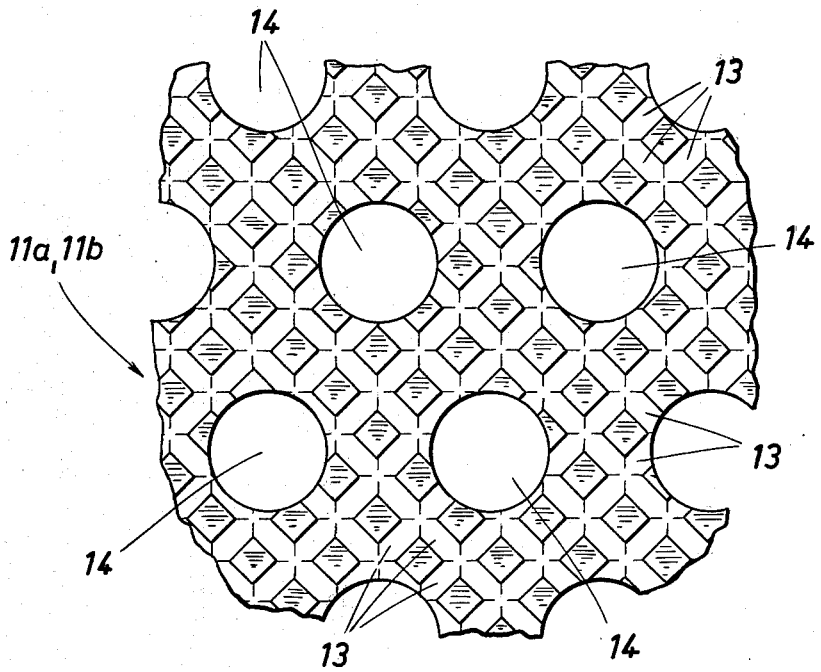
Figure 4:
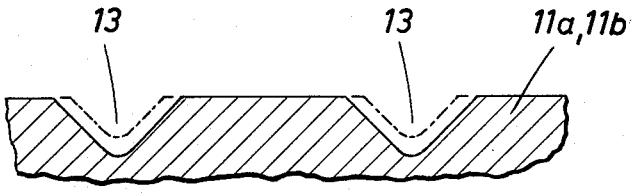

An embodiment of the invention is shown in simplified views and by way of example on the accompanying drawings, in which FIG. 1 is a side elevation showing apparatus embodying the invention and serving to make a yarn, FIG. 2 is a vertical sectional view showing that apparatus on a larger scale, FIG. 3 is a top plan view showing the surface of a suction drum on an enlarged scale, and FIG. 4 is a sectional view showing the shell of a suction drum on a scale that is larger than that of FIG. 3.

FIG. 1 shows two parallel, juxtaposed, closely spaced apart suction drums 3, which are provided with respective suction inserts 4 and rotate in the same sense. The suction drums 3 are arranged between a drawing frame 1, which consists of a plurality of pairs of rollers rotating at speeds which strongly increase from the receiving end to the delivery end, and withdrawing rollers 2. Owing to the suction inserts 4, the suction drums have suction zones, which face each other and define the triangular space between the suction drums, pull the drawn roving 5 into said triangular space and urge the yarn against the surfaces of both drums.

Another roller drawing frame 6 is disposed over the two suction drums 3 and at its delivery end comprises a pair of delivery rollers 7, which are disposed over the triangular space between the two suction drums 3. The roller drawing frame 6 can be used to deliver covering fibers obtained from drawn rovings 8 to the drawn roving 5 so that the twist of the roving 5 will be fixed by the covering fibers, which have been drawn so that they are parallelized and singled and which are wound around the roving 5. The drawn roving 5 is twisted by means of two rings 9, which are formed by the suction drums 3 and provided with a friction covering 10. Because at least part of the rings 9 is permeable to air and connected to the suction inserts 4, the roving 5 delivered by the drawing frame 1 is pulled into the triangular space between the two rings 9 and is urged against the friction covering of both rings. As a result, the roving 5 cannot disengage the rings 9 even when the yarn is withdrawn at relatively high speed. This will ensure a reliable and uniform twisting of the roving 5 before the covering fibers are applied to it.

In order to ensure a good and uniform wrapping of the roving 5 with the covering fibers, the suction drums 3 have rough surfaces 11*a* and 11*b*. Such rough surfaces will promote an entraining of the covering fibers out of the region of yarn formation if the covering fibers reach the suction drums outside the suction zones. This will be prevented by a delivery duct 12, which is disposed between the pair of delivery rollers 7 of the drawing frame 6 and the suction drums 3. As that delivery duct 12 has an exit adjacent to the suction zones, the singled covering fibers delivered by the delivery duct will be immediately subjected to the influence of the retaining force exerted by the sucked air so that they cannot be entrained by the surface 11*b* of the suction drum which rotates out of the triangular space.

To produce this result, the surfaces 11*a* and 11*b* must have a microstructure which prevents a positive coupling to individual covering fibers. For this purpose there must be no protruding peaks and no undercuts. As is apparent from FIGS. 3 and 4, these requirements can be advantageously met by the provision of intersecting grooves 13, which are triangular in cross-section, and square lands in the form of truncated pyramids. The grooves are interrupted only by the suction holes and extend at an angle of 45° to the generatrices of the suction drums. Conventional yarns can be made if the grooves 13 have a depth of about 150 micrometers.

The microstructure of the surfaces 11*a* or 11*b* of each suction drum may be uniform throughout the axial extent of the suction drum. If the yarn is to be subjected to a special treatment, e.g., to a smoothening treatment, in the axial portion 13 which succeeds the delivery duct 12, a finer microstructure in the processing portion 15 may be desirable.

To ensure a favorable position of the line of yarn formation in the triangular space, the surfaces 11*a* and 11*b* of the drums have different microstructures. The surface 11*a* of the suction drum which rotates toward the triangular space has such a microstructure that it exerts a smaller entraining force on the covering fibers than the surface 11*b* of the other drum, which rotates away from the triangular space. If the microstructures are similar in other respects, this can be accomplished most simply by the selection of a smaller peak-to-valley height. It has been found in practice that the selection of a different microstructure for the suction drum which rotates toward the triangular space so that the entraining forces will be reduced by 30% will result in uniform and soft yarns, which are wrapped with covering fibers in a comparable manner. In a strong simplification of the actual conditions, the entraining force can be suitably decreased in that the peak-to-valley depth of the surface 11*a* of the suction drum rotating toward the triangular space is decreased by the desired percentage whereas the profile configuration is substantially the same. This is indicated in phantom in FIG. 4.

The rough surfaces of the suction drums 3 exert stronger entraining forces on the covering fibers so that these entraining forces have a stronger effect relative to the entire forces. This effect can also be utilized to maintain the yarn in a predetermined position in the triangular space. As that suction drum which rotates toward the triangular space assists the action of the sucked air which draws the yarn into the triangular space, the resultant force pulling the yarn into the triangular space can be controlled by the control of the peripheral velocity of the suction drum which rotates toward the triangular space, provided that there is a suitable difference between the peripheral velocities of the two suction drums. The greater the depth to which the yarn enters the tapering triangular space, the more tightly will the covering fibers be wound around the drawn roving 5 and the harder will be the yarn. It has been found that yarns in hardnesses which are usually required can be made if the peripheral velocity of the suction drum rotating toward the triangular space is lower by 5 to 10% than the peripheral velocity of the other drum. Particularly hard and particularly soft yarns will be obtained if the velocity difference is decreased down to 3% or increased up to 20%. For this purpose, the speed of the suction drum 3 rotating toward the triangular space may be adjustable, e.g., in that said suction drum is driven by a drive motor 16 via a belt drive 17, although different drive means may be provided which permit a change of the transmission ratio.

What is claimed is:

1. In apparatus for making a yarn having at least a predetermined diameter, comprising two juxtaposed, closely spaced apart suction drums having respective peripheral suction zones which face each other and define a generally triangular space between said drums, a drawing frame for delivering a drawn roving to said triangular space at one end thereof, means for twisting said roving and for fixing the resulting twist, including means for rotating said drums in the same sense and covering fiber-delivering means comprising a delivery duct which protrudes into said triangular space and has an exit adjacent to said suction zones, said covering fiber-delivering means being operable to deliver singled covering fibers through said exit to said roving, whereby said roving is wrapped with said covering fibers to form a yarn in said triangular space, and withdrawing means for withdrawing said yarn from said triangular space at the other end thereof, the improvement residing in that each of said suction drums has a rough peripheral surface which defines said triangular space and which has a microstructure that prevents a positive coupling between said peripheral surface and individual covering fibers and which has a peak-to-valley height that is up to one-half of said predetermined diameter.

2. The improvement set forth in claim 1, wherein said apparatus is adapted to make a yarn up to a second predetermined diameter and said peak-to-valley height is up to one-fourth of said second predetermined diameter.

3. The improvement set forth in claim 1, wherein said covering fiber-delivering means are operable to deliver covering fibers having at least a third predetermined diameter and said peak-to-valley height is up to five times said third predetermined diameter.

4. The improvement set forth in claim 1, wherein said drive means are operable to rotate one of said drums toward said triangular space at a peripheral velocity that is 3 to 20% less than the peripheral velocity of the other of said drums.

5. The improvement set forth in claim 4, wherein said drive means are operable to rotate said one drum at a peripheral velocity which is 5 to 10% less than the peripheral velocity of the other of said drums.

6. The improvement set forth in claim 4, wherein said drive means comprise means for adjusting the speed of said one drum.

7. The improvement set forth in claim 1, wherein said drive means are operable to rotate one of said drums toward said triangular space and said one drum has such a microstructure that the entraining force exerted by the peripheral surface of said one drum on covering fibers contacting said peripheral surfaces of said drums in said triangular space is up to 30% less than the entraining force exerted by the peripheral surface of the other of said drums on covering fibers contacting said peripheral surfaces.

8. The improvement set forth in claim 7, wherein said peripheral surface of said one drum has a smaller peak-to-valley height than the peripheral surface of the other of said drums.

* * * * *